US005105708A

United States Patent [19]

Suzuki et al.

[11] Patent Number: 5,105,708

[45] Date of Patent: Apr. 21, 1992

[54] MOTION CONTROLLED MUSICAL TONE CONTROL APPARATUS

[75] Inventors: Hideo Suzuki; Masao Sakama, both of Hamamatsu, Japan

[73] Assignee: Yamaha Corporation, Hamamatsu, Japan

[21] Appl. No.: 759,736

[22] Filed: Sep. 12, 1991

Related U.S. Application Data

[63] Continuation of Ser. No. 352,125, May 15, 1989, abandoned.

[30] Foreign Application Priority Data

May 18, 1988 [JP] Japan ..... 63-121489

[51] Int. Cl.[5] ..... G10H 1/06; G10H 1/18; G10H 1/46

[52] U.S. Cl. ..... 84/600; 84/658; 84/659; 84/665

[58] Field of Search ..... 84/600, 615-620, 84/622-633, 644, 653-665, 670, 678-690, 692-711, 718; 128/782

[56] References Cited

U.S. PATENT DOCUMENTS

| | | | |
|---|---|---|---|
| 4,245,539 | 1/1981 | Jones . | |
| 4,339,979 | 7/1982 | Norman | 84/627 |
| 4,627,324 | 12/1986 | Zwosta . | |
| 4,776,253 | 10/1988 | Downes . | |
| 4,794,838 | 1/1989 | Corrigau | 84/600 |
| 4,905,560 | 3/1990 | Suzuki et al. | 84/600 |

FOREIGN PATENT DOCUMENTS 62-172432 11/1987 Japan .
63-123094 5/1988 Japan .

OTHER PUBLICATIONS

Published European Patent Application No. 264,782 to Hiyoshi.

*Primary Examiner*—Stanley J. Witkowski
*Attorney, Agent, or Firm*—Graham & James

[57] ABSTRACT

The present invention relates to a musical tone control apparatus which controls the generation of musical tone in response to the motion of player. By retaining holding means in a performer's hands and depressing finger pressure sensing means by a finger or fingers, signals are generated in response to the magnitude of finger pressure. When the operation signal generating means receives these signals, a pulse is generated therefrom. The beginning of the pulse is determined by associating the signals from the finger pressure sensing means with a predetermined first signal level. The ending of the pulse is determined by associating the signals from the finger pressure sending means with a predetermined second signal level, the predetermined second signal level being closer to a reference signal level which is set in releasing position than the predetermined first signal level. That is, the time interval of the pulse is determined by the characteristic of the hysteresis. Then, the musical tone control data generating means generates musical tone control data in response to the pulse. Thus, this musical tone control data is transmitted to a musical tone generating apparatus while a performer performs with vigorous movement.

15 Claims, 8 Drawing Sheets

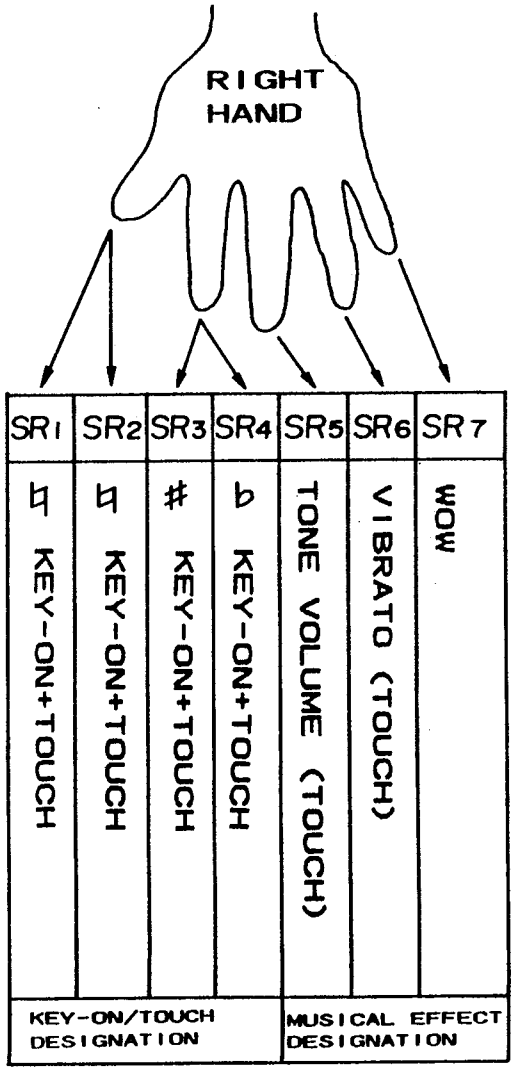
FIG. 12
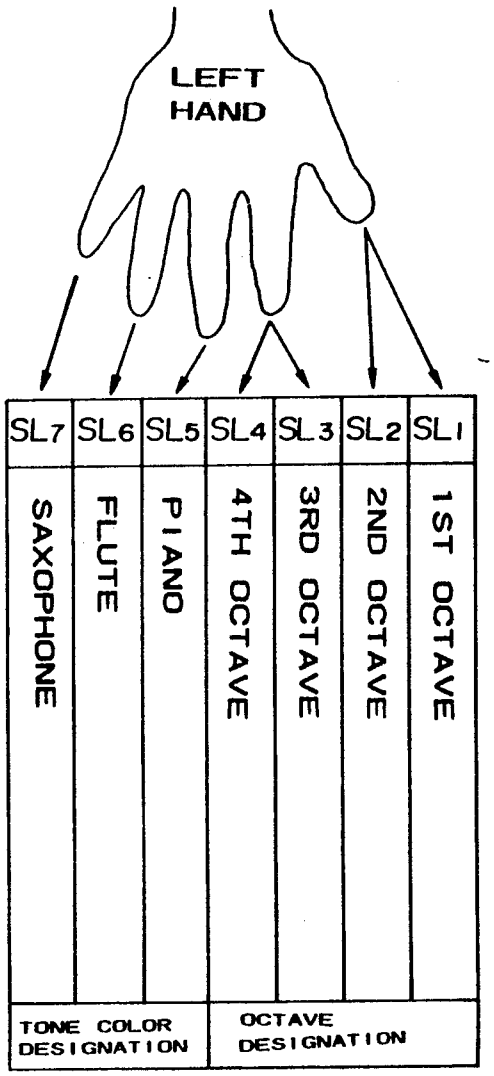
FIG. 13
| DIRECTION OF ARM | | ON SWITCH | | | | MUSICAL SCALE |
|---|---|---|---|---|---|---|
| REFT | RIGHT | La | Lb | Ra | Rb | |
| UPPER | UPPER | ○ | ○ | ○ | ○ | $C^n$ |
| UPPER | MIDDLE | ○ | ○ | ○ | × | $D^n$ |
| UPPER | LOWER | ○ | ○ | × | × | $E^n$ |
| MIDDLE | UPPER | ○ | × | ○ | ○ | $F^n$ |
| MIDDLE | MIDDLE | ○ | × | ○ | × | $G^n$ |
| MIDDLE | LOWER | ○ | × | × | × | $A^n$ |
| LOWER | UPPER | × | × | ○ | ○ | $B^n$ |
| LOWER | MIDDLE | × | × | ○ | × | $C^{n+1}$ |
| LOWER | LOWER | × | × | × | × | $D^{n+1}$ |
○: ON X: OFF
FIG. 14

MOTION CONTROLLED MUSICAL TONE CONTROL APPARATUS

This is a continuation of application Ser. No. 352,125 filed on May 15, 1989, now abandoned.

BACKGROUND OF THE INVENTION

1. Field of the Invention

The present invention relates to a musical tone control apparatus which controls the generation of musical tones in response to the motion of a player.

2. Prior Art

Conventional electrical keyboard musical instruments are usually stationary and are played while sitting or standing at the keyboard. Therefore, it is impossible to play these musical instruments while moving freely to vigorous dance or exercise.

SUMMARY OF THE INVENTION

It is accordingly an object of the present invention to provide a musical tone control apparatus which can be played by a performer (or player) by vigorous movement.

It is another object of the present invention to provide a musical tone control apparatus which can steadily generate and transmit musical tone control data to the musical tone generating apparatus even during the performance of vigorous movement.

In an aspect of the present invention, there is provided a musical tone control apparatus comprising: movement sensing means for sensing the magnitude of movement and for generating a first signal in response to the sensed magnitude of movement, the movement sensing means retained by a part of the human body; signal generating means for generating a second signal in accordance with a predetermined first signal level associated with the beginning of the first signal outputted from the movement sensing means and a predetermined second signal level associated with the end of the signal from the movement sensing means; and musical tone control data generating means for generating musical tone control data to control a musical tone generating apparatus based on the second signal from the signal generating means.

BRIEF DESCRIPTION OF THE DRAWINGS

FIGS. 12 to 14 are diagrams showing the functions of each finger selector and each arm position detector.

DESCRIPTION OF THE PREFERRED EMBODIMENT

Hereinafter, an embodiment of the present invention is described by reference to the drawings.

Figure 1:
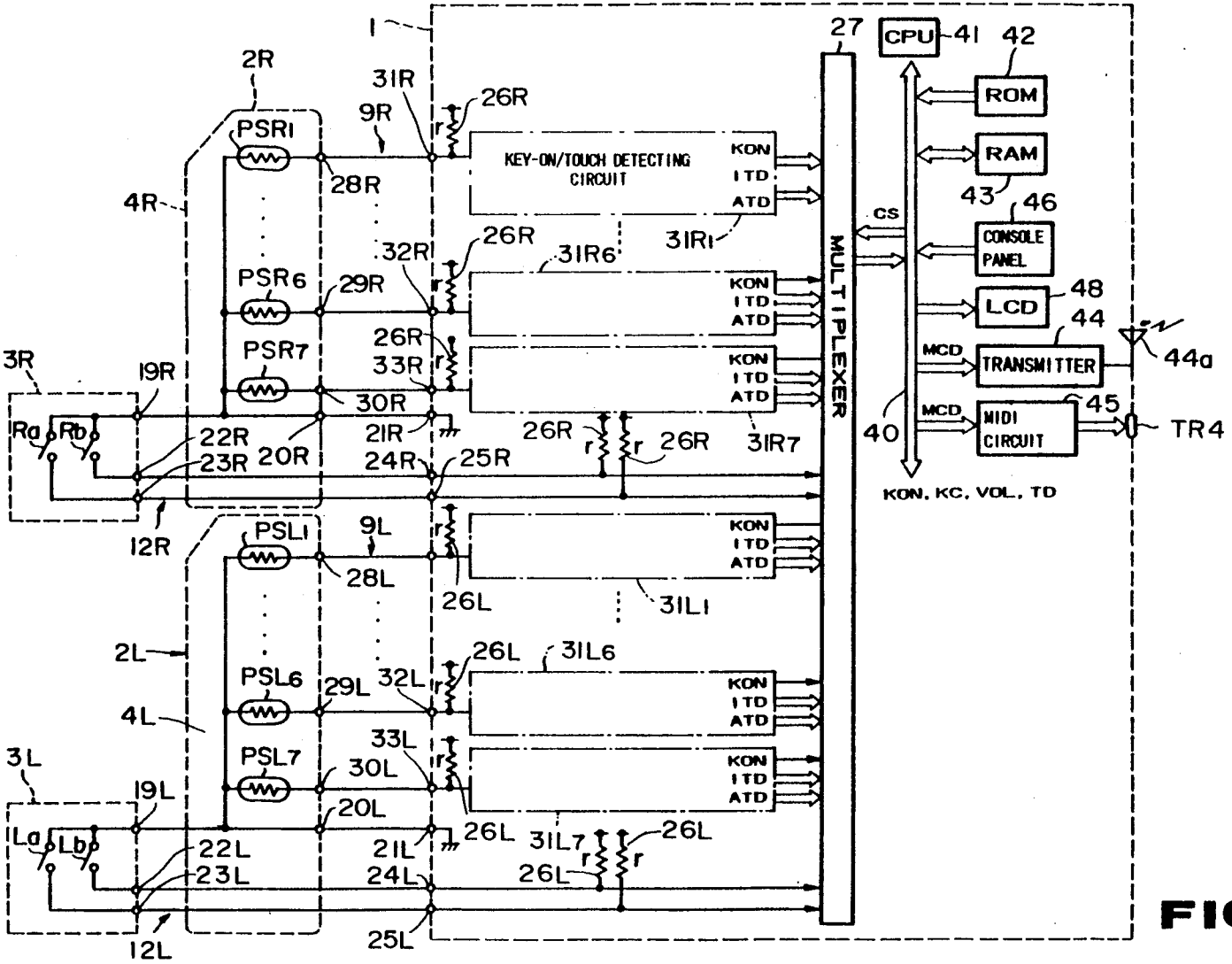
FIG. 1 is a block diagram showing an electronic control construction of the musical tone control apparatus in an embodiment.
Figure 2:
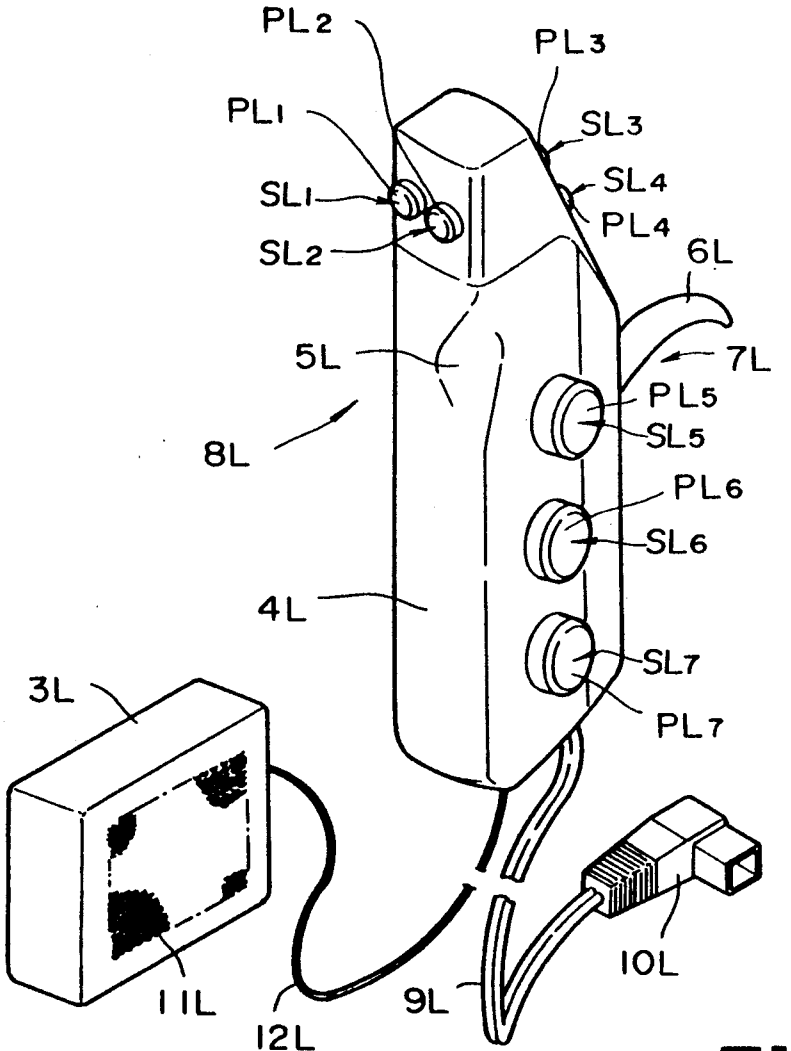
FIG. 2 is a perspective view showing the left grip and left-arm position detector in the embodiment.

FIG. 1 shows an electronic control circuit block diagram for the musical tone control apparatus which includes controller 1, right grip 2R, left grip 2L, right-arm position detector 3R, and left-arm position detector 3L. The details of the electronic control circuit block diagram are described later. Herein, right grip 2R and left grip 2L are described by FIGS. 2 and 3. Right grip 2R is used for the right hand while left grip 2L is for the left hand. Accordingly, both right grip 2R and left grip 2L are of symmetrical shape to be held by hands, as are right-arm position detector 3R and left-arm position detector 3L. Herein, right grip 2R and right-arm position detector 3R are described in this embodiment, while left grip 2L and left-arm position detector 3L, having identical reference numerals with additional "L" are omitted from the description of this embodiment.

Numeral 4R designates a case capable of being held by hand. This case 4R has curved surface 5R to be fitted to the right hand surface at the base between the thumb and index fingers when case 4R is gripped by the right hand. Case 4R also has stud 6R extending from the finger side 7R of case 4R to be held between the middle and ring fingers so that a firm grip is assured in the right hand. In addition, case 4R has seven finger selectors $SR_1$ to $SR_7$, incorporated therein. Each of the finger selectors $SR_1$ to $SR_7$ comprises pushbuttons $PR_1$ to $PR_7$ to be depressed by the fingers, and piezoelectric elements which are incorporated with pushbuttons $PR_1$ to $PR_7$, to vary the intrinsic resistance of each piezoelectric element in response to the magnitude of pressure when any pushbuttons $PR_1$ to $PR_7$ are depressed by a finger or fingers. Piezoelectric elements are shown in FIG. 1 designated as $PSR_1$ to $PSR_7$.

Figure 3:
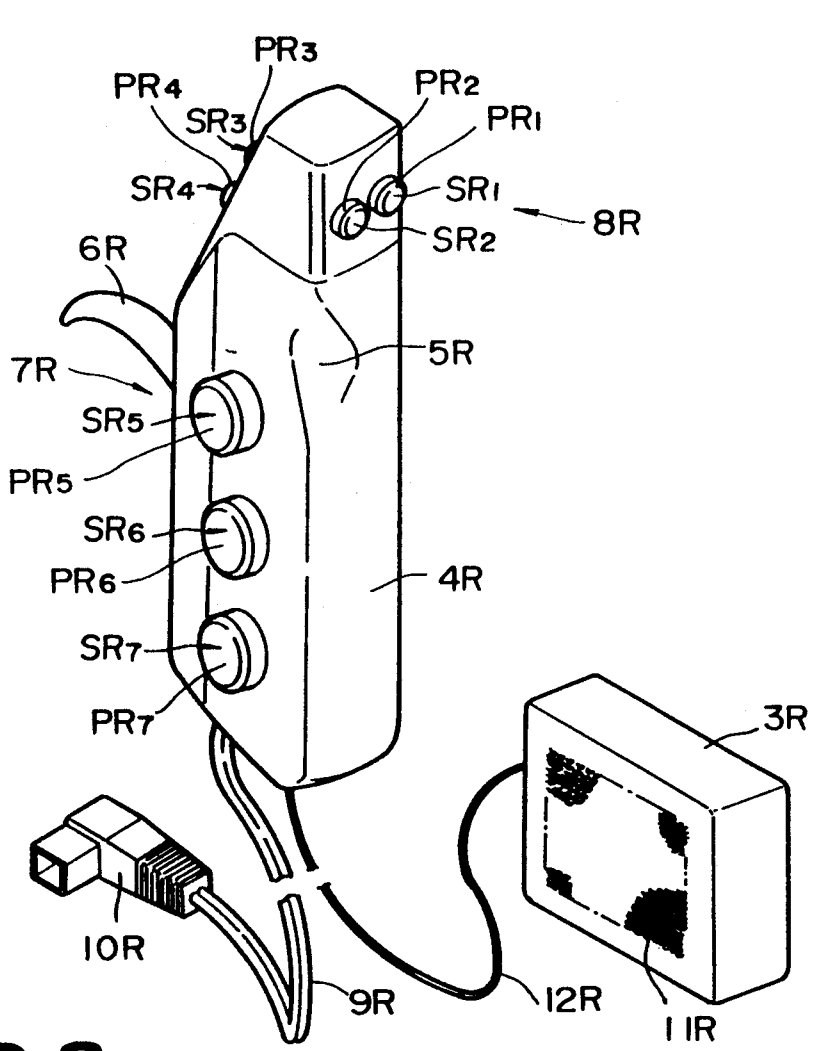
FIG. 3 is a perspective view showing the right grip and right-arm position detector in the embodiment.

The arrangement of finger selectors $SR_1$ to $SR_7$ is now described with reference to FIG. 3. Finger selectors $SR_1$ to $SR_7$ are at the corresponding finger positions on the surface thereof, to be depressed by the fingers when case 4R is gripped by the right hand. Finger selectors $SR_1$ and $SR_2$ are laterally placed on the upper and wrist side 8R of case 4R to be depressed by the thumb. Finger selectors $SR_3$ and $SR_4$ are also laterally placed on the upper and finger side 7R of case 4R to be depressed by the index finger. In addition, finger selectors $SR_5$, $SR_6$, and $SR_7$ are vertically placed on the inner side of the right hand, or the inner side of the right arm of case 4R to be depressed by the middle, ring, or little fingers, respectively. In the above described layout, finger selectors $SR_1$ to $SR_7$ can be depressed by the fingers smoothly. Accordingly, depressing any pushbuttons $PR_1$ to $PR_7$ urges the piezoelectric elements. Thus, the resistance of the piezoelectric elements changes in response to the magnitude of pressure which is received from pushbuttons $PR_1$ to $PR_7$, and thereby each piezoelectric element generates signals. These resistance variation signals are transmitted to controller 1 through cable 9R and plug 10R.

Right-arm position detector 3R is of a box-shape having the male side of plain fastener 11R. Right-arm position detector 3R is connected to case 4R by cable 12R. This cable 12R passes through case 4R, and connects to controller 1 except for the ground; in other words, case 4R functions such as a junction box for right-arm position detector 3R, as shown in FIG. 1. The arrangement of finger selectors $SL_1$ to $SL_7$, is described in FIG. 2, corresponds to that of the portion.

Figure 4:
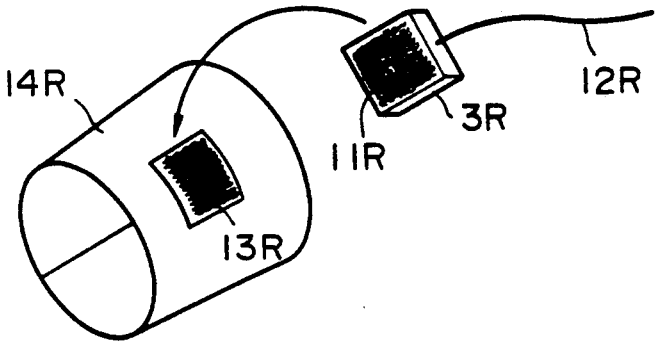
FIG. 4 is a perspective view showing an example of an attachment of the position detector to the attaching band.

FIG. 4 shows plain fastener 11R formed on right-arm position detector 3R removably attached to the female side of plain fastener 13R which is formed on band 14R. This band 14R is attached to the right arm.

Figure 5:
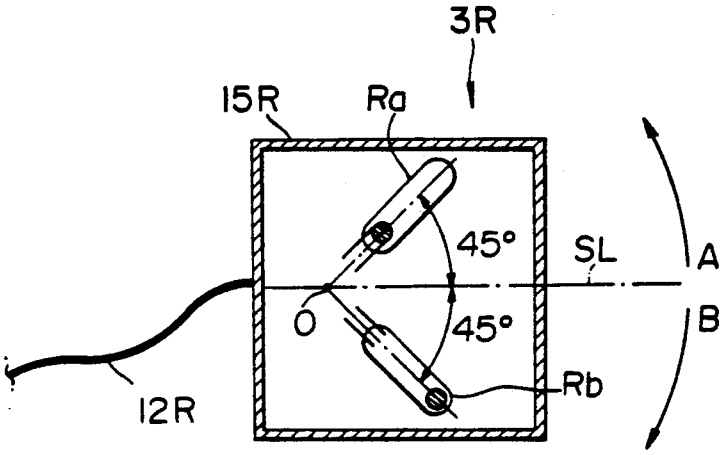
FIG. 5 is an enlarged section view showing the position detector.

FIG. 5 shows a section view of right-arm position detector 3R which comprises case 15R, and mercury switches Ra and Rb. Both mercury switches Ra and Rb are placed in case 15R, in which each axis of the mercury switches Ra and Rb are in perpendicular relation to each other. In other, words, the axis of mercury switch Ra is placed at a 45° angle to the upper side from predetermined horizontal line SL, while the axis of mercury switch Rb is placed at a 45° angle to the lower side from horizontal line SL.

Figure 6:
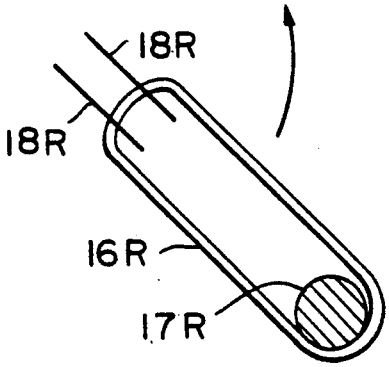
FIG. 6 is a section view showing the construction of the mercury switch.

Both mercury switches Ra and Rb comprise glass bulb 16R, mercury 17R, and contacts 18R, as shown in FIG. 6. The inside of glass bulb 16R is maintained as a vacuum or is filled with an inert gas. The ends of contacts 18R protrude into glass bulb 16R to form a contact when mercury 17R touches both contacts 18R; while the other ends of contacts 18R are connected to controller 1 through cable 12R. Accordingly, in FIG. 5, when right-arm position detector 3R rotates about point 0 in the direction of arrows A or B, either mercury switch Ra or Rb is opened or closed. In FIG. 5, mercury switch Ra is closed while mercury switch Rb is opened. When the rotation of right-arm position detector 3R about point 0 in arrow direction A from horizontal line SL is more than 45°, mercury switch Ra is maintained closed, while mercury switch Rb is changed to closed. Conversely, when rotating right-arm position detector 3R about point 0 in the direction of arrow B from horizontal line SL more than 45°, mercury switch Ra is changed to opened while mercury switch Rb is maintained in an open state. These opened and closed signals represent ON-OFF signals which are transmitted to controller 1 through cable 12R, case 4R, cable 9R, and plug 10R as shown in FIG. 3 and FIG. 1.

The above-described right-arm position detector 3R, including mercury switches Ra and Rb, is used for measuring the right arm position; however, a potentiometer may be used to measure the arm position instead. In addition, a strain-gauge, semiconductor touch sensor can be used for measuring the arm position.

Next, the electronic control circuit block diagram is described by reference to FIG. 1. One contact 18R (FIG. 5) of mercury switch Ra and one contact 18R (FIG. 5) of mercury switch Rb are connected to each other, and this connection is connected to terminal 19R which is placed in case 15R. From terminal 19R, another connection is connected to common sides of the piezoelectric elements $PSR_1$ to $PSR_7$ through cable 12R, and is then connected to terminal 20R which is placed in case 4R. This connection is connected to terminal 21R placed in controller 1 to the ground through cable 9R and plug 10R. The other contact 18R of mercury switch Ra and the other contact 18R of mercury switch Rb are connected to terminal 22R and 23R, both of which are placed in case 15R, then these connections pass through case 4R through cable 12R. These connections are also connected to terminals 24R and 25R, both of which are placed in controller 1 respectively. From these terminals 24R and 25R, both connections are connected to each end of the resisters 26R, and are then connected to multiplexer 27 to maintain the predetermined voltage which is supplied to multiplexer 27 as a detecting signal. This multiplexer 27 is described later.

The other sides of the piezoelectric elements $PSR_1$ to $PSR_7$ are connected to terminals 28R, 29R, and 30R which are placed in case 4R. These connections are also connected to terminals 31R, 32R, and 33R which are placed in controller 1 through cable 9R. These connections are connected to each end of the resisters 26R, and are then connected to each input of the key-on touch detecting circuits $31R_1$ to $31R_7$ to maintain their respective predetermined voltages which are supplied from piezoelectric elements $PSR_1$ to $PSR_7$ as detecting signals. Each of key-on touch detecting circuits $31R_1$ to $31R_7$ has three output terminals which are connected to multiplexer 27. These output terminals of key-on touch detecting circuits $31R_1$ to $31R_7$ output key-on signal KON, initial-touch data ITD for controlling musical tone corresponding to key-depression velocity, and after-touch data ATD for controlling musical tone representing the forcefulness of key depression when a key is depressed, each of which are based on the detecting signals supplied from piezoelectric elements $PSR_1$ to $PSR_7$. Accordingly, key-on signal KON becomes ON when each signal corresponding to piezoelectric elements $PSR_1$ to $PSR_7$ is higher than the first signal level. While key-on signal KON becomes OFF when each signal corresponding to piezoelectric elements $PSR_1$ to $PSR_7$ is lower than the second signal level. Initial-touch data ITD is data which corresponds to acceleration in accordance with the magnitude of touching speed when fingers touch one of the pushbuttons $PR_1$ to $PR_7$. After-touch data ATD is data which corresponds, to the continuous variation of the pressure magnitude when the fingers depress several pushbuttons $PR_1$ to $PR_7$, and then released the fingers from pushbuttons $PR_1$ to $PR_7$. Details of key-on signal KON and initial-touch data ITD are described later.

Figure 7:
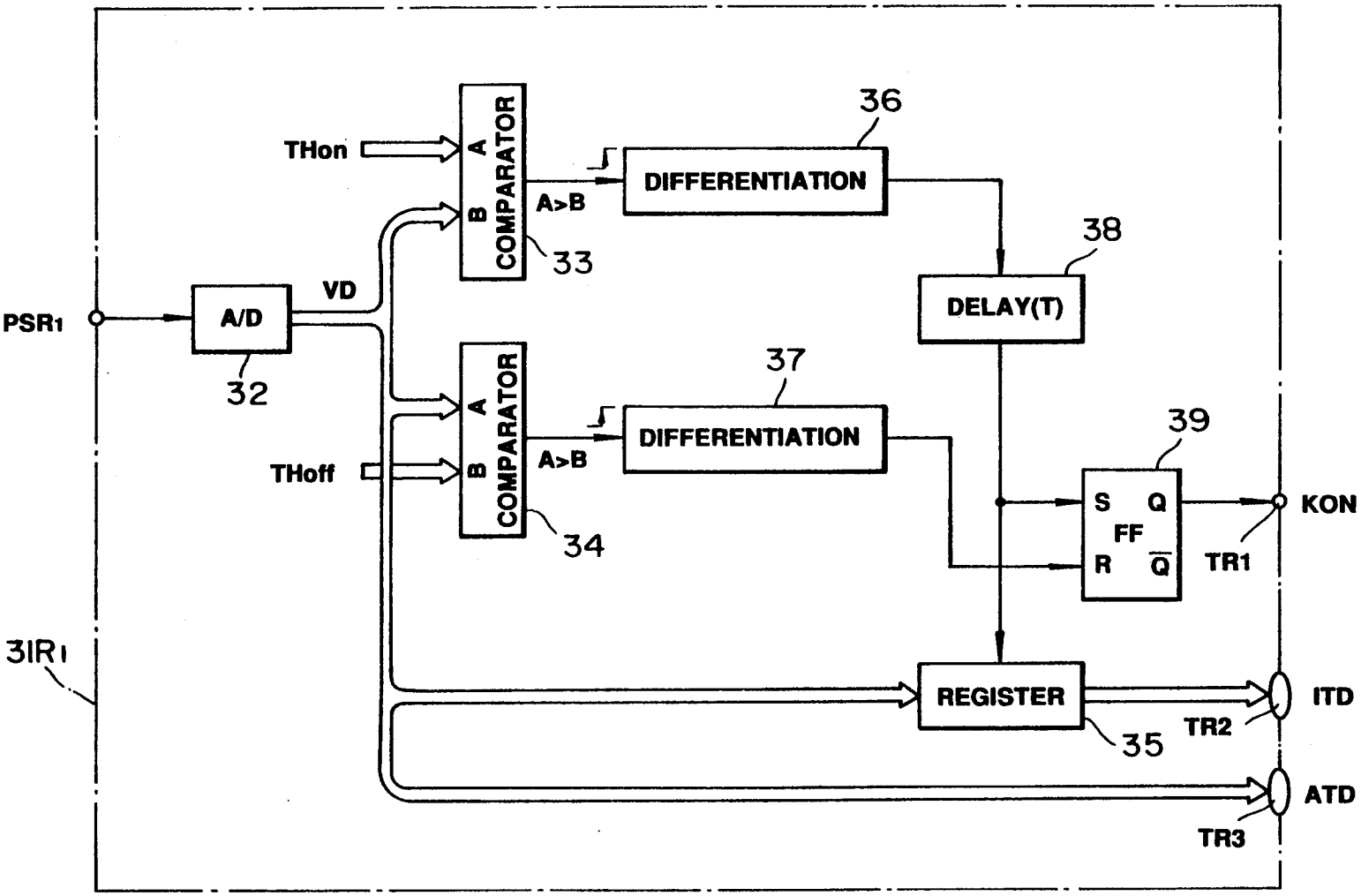
FIG. 7 is a block diagram showing the key-on touch detecting circuit.

Hereinafter, each construction of key-on touch detecting circuit $31R_1$ is described by reference to FIG. 7. This key-on touch detecting circuit $31R_1$ is of similar construction to key-on touch detecting circuits $31R_2$ to $31R_7$, therefore, the detailed description of these constructions is omitted. A-D converter 32 changes detecting signals, supplied from one of the piezoelectric elements $PSR_1$ to $PSR_7$, to digital signals consisting of predetermined bits, then this digital signal is outputted as sensor signal VD. This sensor signal VD is supplied to input terminal B of comparator 33, input terminal A of comparator 34, input of register 35, and terminal TR3. In the internal construction of key-on touch detecting circuit $31R_1$, the signal from A-D converter 32 to terminal TR3 is designated sensor signal VD, then a similar signal which is outputted from terminal TR3 is designated by after-touch signal ATD.

Figure 8:
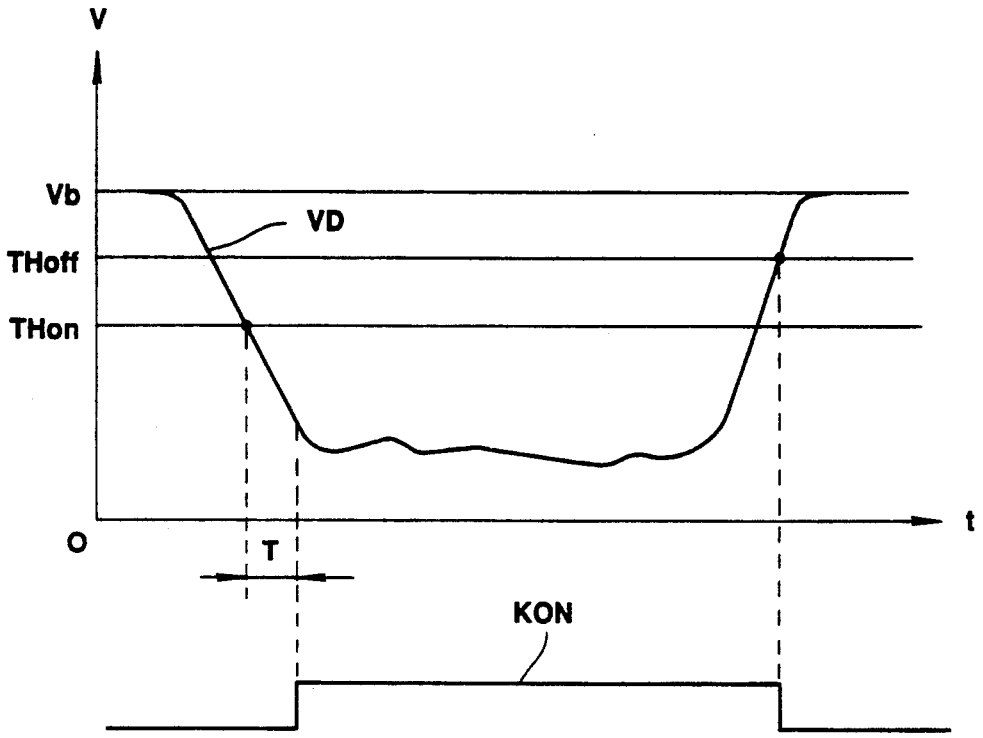
FIG. 8 is a graph showing the wave form for sensor data and key-on signal variation.

FIG. 8 shows the characteristic of sensor signal VD. This sensor signal VD is described in FIG. 7. Comparator 33 compares the value of sensor signal VD with predetermined first threshold THon. Then, the comparator 33 outputs signal "1" to differentiation circuit 36 when the value of sensor signal VD is smaller than first threshold THon, while outputting signal "0" to differentiation circuit 36 when the value of sensor signal VD is larger than first threshold THon. In other words, when the signal at terminal A is larger than the signal at terminal B, comparator 33 outputs signal "1" to differentiation circuit 36; and conversely, when the signal at terminal A is smaller than the signal at terminal B, comparator 33 outputs signal "0" to differentiation circuit 36. In addition, comparator 34 compares the value of sensor signal VD with predetermined second threshold THoff. Then, comparator 34 outputs signal "0" to differentiation circuit 37 when the value of sensor signal VD is smaller than the second threshold THoff, while outputting signal "1" to differentiation circuit 37 when the value of sensor signal VD is larger than the second threshold THoff. In other words, when the signal at terminal A is larger than the signal at terminal B, comparator 34 outputs signal "1" to differentiation circuit 37; and conversely, when the signal at terminal A is smaller than the signal at terminal B, comparator 34 outputs signal "0" to differentiation circuit 37.

This second threshold THoff is larger than first threshold THon and smaller than reference value Vb. This reference value Vb shows the equal magnitude of sensor signal VD, that is, piezoelectric element $PSR_1$ is not receiving pressure from pushbutton $PR_1$, or pushbutton $PR_1$ is in the released position.

Differentiation circuit 36 generates a pulse signal which is differentiated at the leading edge of signal "1" outputted from comparator 33, then outputs this pulse signal to delay circuit 38. Delay circuit 38 makes delay time T (FIG. 8) to output a pulse signal with the delay to set terminal S of flip-flop circuit 39 and the trigger input of register 35. Similarly, differentiation circuit 37 generates a pulse signal which is differentiate at the leading edge of signal "1" outputted from comparator 34, then outputs this pulse signal to reset terminal R of flip-flop circuit 39.

Flip-flop circuit 39 is set by the delayed pulse signal from delay circuit 38, then outputs ON state of key-on signal KON from output terminal Q to terminal TR1. This ON state of key-on signal KON is delayed by delay time T. Flip-flop circuit 39 is reset by this pulse signal from differential circuit 37 to produce OFF state of key-on signal KON as shown in FIG. 8.

Register 35 outputs initial-touch data ITD to terminal TR2 when the pulse signal is inputted from delay circuit 38 to the trigger input thereof so that sensor signal VD is supplied thereinto.

Accordingly, key-on signal KON rises after delay time T when the pulse signal is supplied to set terminal S of flip-flop circuit 39 so that the value of sensor signal VD becomes smaller than first threshold THon (A>B at comparator 33). While key-on signal KON falls when the pulse signal is supplied to reset terminal R of flip-flop circuit 39 so that the value of sensor signal VD becomes larger than second threshold THoff (A>B at comparator 34). Thus, first threshold THon and second threshold THoff have the following relationship.

$$THon < THoff$$

According to this relationship, key-on signal KON is generated in response to the hysteresis characteristic, that is, the time interval of key-on signal KON is determined by the lower value of first threshold THon for rising key-on signal KON, and the higher value of second threshold THoff for falling key-on signal KON along time t (FIG. 8). As a result, the "0" state of key-on signal KON is hardly changed to the "1" state after turning into the "0" state, and vice versa. In other words, key-on signal KON is not changed from "1" to "0" or, from "0" to "1", even though sensor signal VD changes within the time interval thereof. Furthermore, in the case where pushbutton $PR_1$ is depressed while the performer moves, the output of piezoelectric element $PSR_1$ is changed in response to the movement. This makes sensor signal VD interfere with key-on signal KON. However, key-on signal KON is formed in response to the hysteresis characteristic, therefore, key-on signal KON does not respond to the change in sensor signal VD. Thus, key-on signal KON is essentially stable when being outputted from output terminal Q of flip-flop circuit 39.

In other words, the above is described as follows; key-on signal KON rises when the value of sensor signal VD becomes equal to or smaller than the first threshold THon, and it falls when sensor signal VD becomes equal to or greater than the second threshold THoff.

In a modification of the above, key-on signal KON can be raised when sensor signal VD increases from reference value Vb, while key-on signal KON can be made to fall when sensor signal VD decreases toward reference value Vb, In this case, reference value Vb is set lower than the first and the second threshold THon and THoff.

Figure 9:
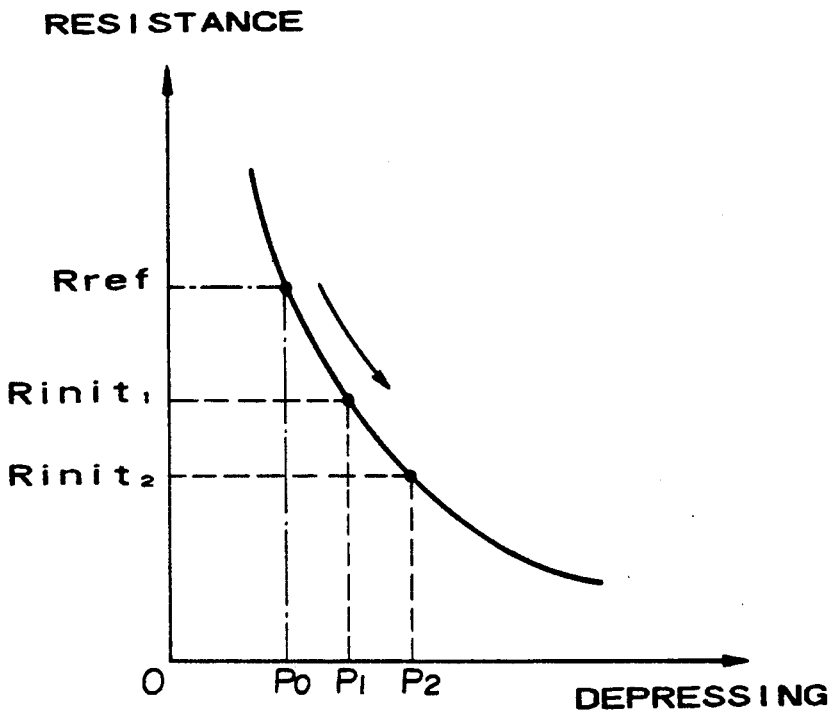
FIG. 9 is a graph showing the characteristic curve of the piezoelectric element.

Next, initial-touch signal ITD is described with reference to FIG. 9. FIG. 9 shows the variation of resistance in response to the magnitude of pressure which is applied to piezoelectric element $PSR_1$ by depressing pushbutton $PR_1$. In this drawing, when the magnitude of pressure is $P_0$, the value of resistance is set in Rref. That is, sensor signal VD is equal to reference value Vb when pushbutton $PR_1$ is in the released position. In the case where a finger touch to pushbutton $PR_1$ is relatively soft, that is, the acceleration in response to the depressing speed of pushbutton $PR_1$ is low, the magnitude of the pressure becomes $P_1$ in response to the time passed. At this time, the value of resistance becomes Rinitl. When the finger touch is relatively strong, that is, the acceleration in response to the depressing speed of pushbutton $PR_1$ is high, the magnitude of the pressure becomes $P_2$ which is larger than $P_1$ in response to the time passed. The value of the resistance then becomes Rinit2 which is smaller than Rinit1. Accordingly, in the time when the magnitude of pressure becomes larger than $P_0$, the resistance variation of piezoelectric element $PSR_1$ is determined by the magnitude of finger pressure, that is, the larger the magnitude of the finger pressure is, the lower the value of the resistance becomes. While the smaller the magnitude of finger pressure is, the higher the value of resistance becomes. Herein, since sensor signal VD outputted from A–D converter 32 corresponds to the resistance variation of piezoelectric element $PSR_1$, initial-touch signal ITD is obtained by latching sensor signal VD in register 35.

The above has been described for key-on touch detecting circuit $31R_1$. The construction of the other key-on touch detecting circuits $31R_2$ to $31R_7$ is similar to key-on touch detecting circuit $31R_1$, therefore, the description of them is omitted. In addition, in FIGS. 1, 7, 8, and 9, the construction and description of key-on touch detecting circuits $31L_1$ to $31L_7$ is identical to that of key-on touch detecting circuits $31R_1$ to $31R_7$.

In FIG. 1, key-on signal KON, initial-touch signal ITD, and after-touch signal ATD are supplied to multiplexer 27. When channel-select signal CS from CPU (central processing unit) 41 is supplied to one of the select terminals which are arranged in multiplexer 27, multiplexer 27 outputs the following signals to bus 40 as shown by the arrow: key-on signal KON, initial-touch signal ITD, after-touch signal ATD corresponding to key-on touch detecting circuit $31R_1$ to $31R_7$, or $31L_1$ to $31L_7$, and an ON-OFF signal outputted from right-arm position detector 3R or left-arm position detector 3L.

Herein numeral 42 designates read-only memory ROM which stores programs used in CPU 41. Numeral 43 designates random-access memory RAM which is used as the work area for the programs. Accordingly, CPU 41 generates channel-select signal CS which is, in turn, changed so as to correspond to the select terminals connected to key-on touch detecting circuit $31R_1$ to $31L_7$, right-arm position detector 3R, and left-arm position detector 3L. When one of the select terminals is selected to channel-select signal CS by scanning, key-on signal KON, initial-touch signal ITD, aftertouch signal ATD, and an ON-OFF signal are transmitted to RAM 43 through bus 40. CPU 41 generates key-code data KC to indicate tone pitch, tone volume data VOL to indicate tone volume, and tone color indicating data TD to indicate tone color based on the receiving signals, and also generates musical tone control data MCD which consists of the above-described key-on signal KON, key-code data KC, tone volume data VOL, and tone color indicating data TD. This musical tone control data MCD is transferred to transmitter 44 and MIDI circuit 45. Transmitter 44 is used for wireless transmission to transmit musical tone control data MCD which is modulated by a carrier, to a musical tone generating apparatus. MIDI circuit 45 converts musical tone control data MCD to MIDI (Musical Instrument Digital Interface) standard data to transfer to the musical tone generating apparatus through terminal TR4 in the case of wire transmission.

Numeral 46 designates a control panel which consists of pushswitches 47 and a code converter which is incorporated in control panel 46 to generate a code in response to signals from pushswitches 47, and which then transfers the code to CPU 41. Numeral 48 designates liquid crystal display LCD to indicate operation modes such as wireless or wire, rhythm mode, or the like.

Figure 11:
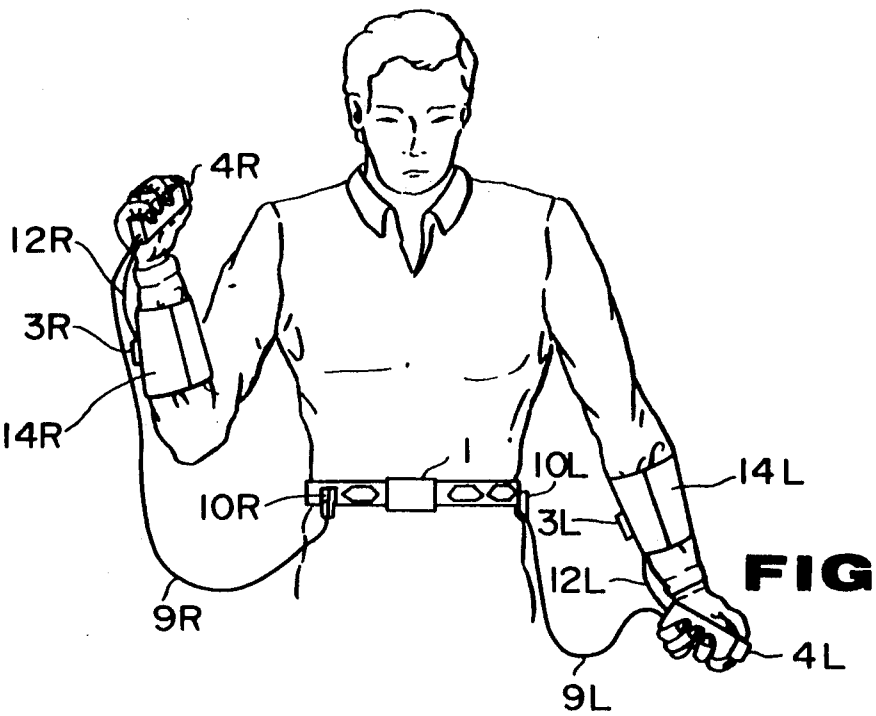
FIG. 11 is a front view showing the entire construction of the musical tone control apparatus attached to the performer.
Figure 10:
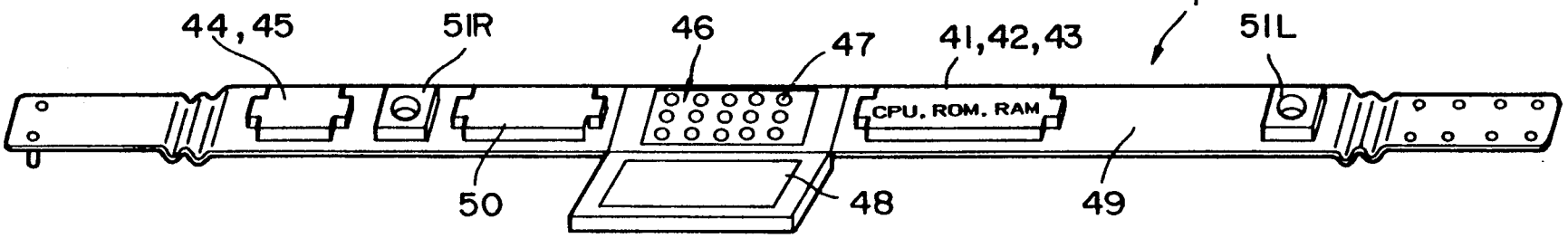
FIG. 10 is a perspective view showing the layout of the controller.

FIG. 10 shows the layout of controller 1. All components of controller 1 are arranged on belt 49 which is attached to the waist of the performer as shown in FIG. 11. Control panel 46 is placed about the center of belt 49, in which LCD 48 is hinged to the lower side thereof to monitor the display surface. Battery 50, socket 51R, transmitter 44, and MIDI circuit 45 are arranged on belt 49 to one side of control panel 46, in which transmitter 44 and MIDI circuit 45 are composed in one module; While CPU 41, ROM 42, RAM 43, and socket 51L are arranged on the other side so that CPU 41, ROM 42, and RAM 43 are composed in one module.

The operation of the invention is described in accordance with the construction of the musical ton control apparatus which has been described heretofore.

First, belt 49 is attached on the performer's waist as shown in FIG. 11. In this case, the musical tone generating apparatus is operated by wire transmission. Therefore, terminal TR4, which is not shown in FIG. 10, is connected to the musical tone generating apparatus by cable. Pushswitch 47 for the power source is depressed to turn controller 1 on, while the power source for the musical tone generating apparatus is turned on. Then, by selecting another pushswitch 47, the type of transmission is selected, that is, wire transmission; MIDI standard data is the transmitted from terminal TR4 to the musical tone generating apparatus. By selecting another push switches 47, the functions of finger selectors $SR_1$ to $SR_7$ and $SL_1$ to $SL_7$, right-arm position detector 3R, and left-arm position detector 3L are assigned as shown in FIGS. 12 to 14.

In FIG. 12, finger selectors $SR_1$ to $SR_4$ are assigned to the key-on touch function having the magnitude variation of pressure which corresponds to the natural for $SR_1$ and $SR_2$, the sharp for $SR_3$, and the flat for $SR_4$. Finger selectors $SR_5$ to $SR_7$ are assigned to the musical effect function having the magnitude of tone volume, the magnitude of vibrato, and whether wow exists or not, respectively.

In FIG. 13, finger selectors $SL_1$ to $SL_4$ are assigned to the octave function having first, second, third, and forth octaves, respectively. Finger selectors $SL_5$ to $SL_7$ are assigned to the tone color function having tone colors of piano, flute, and saxophone, respectively.

In FIG. 14, right-arm position detector 3R and left-arm position detector 3L are assigned to the combined function having a musical scale $C^n$, $D^n$, $E^n$, $F^n$, $G^n$, $A^n$, $B^n$, $C^{n+1}$, $D^{n+1}$, in response to the combination of opening (shown as O) and closing (shown as X) states, each of which are obtained from mercury switches Ra, Rb, La, and Lb when moving right and left arms such as upper, middle, and lower positions. This musical scale can be selectively assigned by depressing pushswitches 47.

Then, bands 14R and 14L, each having right and left-arm position detectors 3R and 3L, are attached to both arms. Next, plugs 10R and 10L are plugged in sockets 51R and 51L, respectively, both right and left grips 2R and 2L being griped by the performer's hands. Then, depressing a start-button among pushswitches 47 starts a performance.

Accordingly, the performance is carried out in response to the movement of arms and fingers. At this time, key-on signal KON, initial-touch signal ITD, after-touch signal ATD, and an ON-OFF signal are transferred to RAM 43 in response to channel-select signal CS when this channel-select signal CS, in turn, selects one of the key-on touch detecting circuits $31R_1$ to $31L_7$, and right-arm position detector 3R or left-arm position detector 3L. These signals are converted signals from piezoelectric elements $PSR_1$ to $PSR_4$ which represent key-on touch function, piezoelectric elements $PSR_5$ to $PSR_7$ which represent effect function, piezoelectric elements $PSL_1$ to $PSL_4$ which represent octave function, piezoelectric elements $PSL_5$ to $PSL_7$ which represent tone color function, and right and left-arm position detectors 3R and 3L which represent the musical scale. CPU 41 generates musical tone control data MCD which is transferred to MIDI circuit 45. This MIDI circuit 45 converts musical tone control data MCD to MIDI standard data which is transmitted to musical tone generating apparatus through terminal TR4 and the cable. Thus, the musical tone generating apparatus generates musical tones corresponding to MIDI standard data to be output from a speaker. For example, if both arms are positioned in horizontal or middle position, both mercury switches Ra and La (in left-arm position detector 3L) are turned ON as shown in FIG. 1, therefore, the musical scale $G^n$ is selected as shown in FIG. 14. Pressing finger selector $SL_1$ with the left thumb selects the first octave as shown in FIG. 13. Pressing finger selector $SL_7$ with the left little finger selects the sax as shown in FIG. 13. Accordingly, in FIGS. 12 to 14, depressing finger selector $SR_1$ with the right thumb outputs the musical tone of musical scale $G^1$ with the tone color of the sax from the musical tone generating apparatus corresponding to the magnitude of pressure thereby. Then, depressing finger selector $SR_3$ with the right index finger outputs the musical tone which is sharp by a half tone from the musical scale of $G^1$ corresponding to the magnitude of pressure thereof. Pressing finger selector $SL_4$ with the right index finger outputs the musical tone which is flat by a half tone from the musical scale of $G^1$ corresponding to the magnitude of pressure thereof. Pressing finger selector $SR_5$ with the right middle finger changes the tone volume corresponding to the magnitude of the pressure thereof. Pressing finger selector $SR_6$ with the right ring finger changes the magnitude of the vibrato. In addition, depressing finger selector $SR_7$ with the right little finger supplies wow. These functions, type of transmission, wire or wireless, and the like, are indicated on LCD 48.

In the above description, CPU 41 selects the functions while finger selectors $SL_1$ to $SL_7$ are depressed.

In addition, CPU 41 may maintain these functions if finger selectors $SL_1$ to $SL_7$ are depressed once.

In the case where wireless transmission is selected by one of the pushswitches 47, musical tone control data MCD is transferred to transmitter 44 to transmit to the musical tone generating apparatus by means of antenna 44*a*.

In the above description, right-arm position detector 3R and left-arm position detector 3L are attached on both arms to generate the signal of the musical scale, and right grip 2R and left grip 2L are griped by both hands to generate tone color, tone of the octave, key-on touch, and musical effect, so that musical performance can be carried out while a performer moves in accordance with dancing, exercising or the like.

In addition, the time period of key-on signal KON is determined by first threshold THon and second threshold THoff to cause the waveform to rise and fall, the first threshold THon being of lower voltage than the second threshold THoff. That is, both the first threshold THon and the second threshold THoff are set in accordance with the characteristic of the hysteresis, so that key-on signal KON is not changed from the "1" state to "0" state, or vice versa, during the time period of key-on signal KON. Thus, musical tone control data MCD can be stable enough to be converted to MIDI standard data.

The preferred embodiment described herein is illustrative and not restrictive; the scope of the invention is indicated by the appended claims and all variations which fall within the claims are intended to be embraced therein.

What is claimed is:

1. A musical tone control apparatus comprising:

movement sensing means for sensing the magnitude of movement of a player and generating a first signal in response to the sensed magnitude of movement, said movement sensing means being retainable by part of the human body;

signal generating means for generating an alternative second signal by comparing said first signal with a predetermined first signal level associated with a rising part of said first signal outputted from said movement sensing means and with a predetermined second signal level associated with a falling part of said first signal from said movement sensing means, said signal generating means generating said alternative second signal having one value immediately after said rising part of said first signal exceeds said first signal level and generating said alternative second signal having another value when said falling part of said first signal becomes lower than said second signal level; and musical tone control data generating means for generating musical tone control data to control a musical tone generating apparatus based on said second signal from said signal generating means.

2. An apparatus according to claim 1 wherein said predetermined second signal level is closer to a reference signal than said predetermined first signal level, wherein said reference signal level is determined in the released state of said movement sensing means.

3. An apparatus according to claim 1 wherein said movement sensing means comprises:

holding means retained by a hand;

finger pressure sensing means for sensing the magnitude of pressure responsive to finger pressure applied to said finger pressure sensing means and generating a pressure signal in response to a sensed magnitude of pressure, said finger pressure sensing means arranged in said holding means; and arm position sensing means attached on an arm, said arm position sensing means generating a position signal in response to the position of the arm movement, in which the pressure signal and the position signal comprise the signal from said movement sensing means.

4. A musical tone control apparatus comprising:

movement sensing means for sensing the magnitude of movement of a player and generating a signal in response to the sensed magnitude of movement, said movement sensing means retained by part of the human body;

signal generating means for generating a pulse, the beginning of which is determined by timing when a level of the signal becomes equal to a predetermined first signal level, and the end of which is determined by timing when a level of the signal becomes equal to a predetermined second signal level, in which said signal level is supplied from said movement sensing means; and musical tone control data generating means for generating musical tone control data to control a musical tone generating apparatus based on the pulse from said signal generating means.

5. An apparatus according to claim 4 wherein said predetermined second signal level is closer to a reference signal than said predetermined first signal level, wherein said reference signal level is determined in the released state of said movement sensing means.

6. An apparatus according to claim 4 wherein said movement sensing means comprises:

holding means retained by a hand;

finger pressure sensing means for sensing the magnitude of pressure responsive to finger pressure applied to said finger pressure sensing means and generating a pressure signal in response to a sensed magnitude of pressure, said finger pressure sensing means arranged in said holding means; and arm position sensing means attached on an arm, said arm position sensing means generating a position signal in response to the position of the arm movement, in which the pressure signal and the position signal comprise the signal from said movement sensing means.

7. A musical tone control apparatus comprising:

a pressure sensor for outputting a signal corresponding to an applied pressure of each finger of a player's hand, said pressure sensor being assembled into a holding means having a shape capable of being held by one hand of a player;

detecting means for detecting an operation of a finger and outputting a pulse signal having a first logical level when said signal has a value lower than a first level, said pulse signal having a second logical level when said signal has a value higher than a second level, in which said second level is set closer to a non-pressure level of said pressure sensor than said first level; and musical tone control data generating means for generating musical tone control data, said data being used for controlling a musical tone generating apparatus based on said pulse signal outputted from said detecting means.

8. A method for generating a musical performance employing a plurality of sensors mounted on, or held by, a performer, said sensors including a hand held unit having a plurality of finger-activated switches and an elbow angle sensor, comprising the steps of:

detecting bending actions of the performer's fingers and providing data from said finger switches in response to activation thereof by the performer;

detecting a bending action of the performer's elbow and providing data from said elbow angle sensor related to the bending angle in response to the bending of the performer's elbow;

generating tone control data based on data from said finger switches;

generating musical scale control data based on data from said elbow sensors; and generating musical tones based on said tone control data and on said musical scale control data.

9. A method for controlling a musical performance according to claim 8, wherein said tone control data comprises octave, tone color, key-on/touch or musical effect control data.

10. A method for controlling a musical performance according to claim 9, wherein the tone color control data selects the tone colors of a piano, flute or saxophone.

11. A method for controlling a musical performance according to claim 9, wherein the octave control data designates the first, second, third or fourth octave.

12. A method for controlling a musical performance according to claim 9, wherein the key-on/touch control data designates flat, sharp or natural tones.

13. A method for controlling a musical performance according to claim 9, wherein the musical effect control data corresponds to tone volume, vibrato or wow.

14. A method for controlling a musical performance according to claim 8, wherein said sensors further comprise a second hand held unit having a plurality of switches and wherein said step of generating tone control data comprises providing tone color control data and octave control data based on data from the first hand held unit and providing key-on/touch or musical effect control data based on data from the second hand held unit.

15. A method for controlling a musical performance according to claim 8, wherein said sensors further comprise a second elbow angle sensor, and wherein the combination of data from the two elbow angle sensors selects a musical scale.

* * * * *